United States Patent [19]

Suska

[11] 4,412,711

[45] Nov. 1, 1983

[54] TWO KNUCKLE ELECTRICAL HINGE

[75] Inventor: Charles R. Suska, Roxbury, Conn.

[73] Assignee: The Stanley Works, New Britain, Conn.

[21] Appl. No.: 327,181

[22] Filed: Dec. 3, 1981

[51] Int. Cl.[3] ..... H01R 39/00

[52] U.S. Cl. ..... 339/4

[58] Field of Search ..... 339/4

[56] References Cited

U.S. PATENT DOCUMENTS

| | | | |
|---|---|---|---|
| 352,596 | 11/1886 | Wilson | 339/4 |
| 612,192 | 1/1898 | Chandler | 339/4 |
| 793,703 | 7/1905 | Williams | 16/244 |
| 2,154,860 | 4/1939 | Morse | 16/169 |
| 2,688,733 | 9/1954 | Walter, Jr. | 339/4 |
| 2,700,139 | 1/1955 | Jewell | 339/4 |
| 2,729,473 | 1/1956 | Warshawsky | 285/96.6 |
| 2,778,000 | 1/1957 | Mills | 339/4 |
| 2,817,871 | 12/1957 | Ferry | 16/169 |
| 3,076,163 | 1/1963 | Nodge et al. | 339/4 |
| 3,428,738 | 2/1969 | Zychal | 174/70 |
| 3,499,183 | 3/9170 | Parsons | 16/136 |
| 3,838,234 | 9/1974 | Peterson | 200/61.7 |
| 3,842,386 | 10/1974 | Suska | 339/4 |
| 3,857,625 | 12/1974 | Crane et al. | 339/4 |
| 3,860,312 | 1/1975 | Gordon | 339/4 |
| 3,903,567 | 9/1975 | Suska | 16/189 |
| 3,921,225 | 11/1975 | Suska | 16/136 |
| 3,999,246 | 12/1976 | Suska | 16/136 |
| 4,068,344 | 1/1978 | Okabe | 16/54 |
| 4,116,514 | 9/1978 | Lawrence | 339/4 |
| 4,140,357 | 2/1979 | Wolz et al. | 339/4 |
| 4,168,409 | 9/1979 | McNinch | 339/4 X |

FOREIGN PATENT DOCUMENTS

| | | |
|---|---|---|
| 423319 | 11/1933 | United Kingdom . |
| 1182185 | 2/1970 | United Kingdom . |

OTHER PUBLICATIONS

Drawing dated Mar. 26, 1982, Supplemental to McKinney Hinge Specifications for Type CC and ES Hinges filed Jan. 13, 1982.

Folger Adam Co. Hinge Specifications for 4½ EH Electric Hinge.

Rixson-Firemark, Inc. Hinge Specification and Article for M19 Electric Hinges.

McKinney Hinge Specifications for Type CC and ES Hinges.

*Primary Examiner*—Eugene F. Desmond

*Attorney, Agent, or Firm*—Brumbaugh, Graves, Donohue & Raymond

[57] ABSTRACT

A hinge, preferably a two buckle hinge, for passing electric current between a door and frame through one or more concealed, tamperproof electrical wires includes a solid hinge pin that is disposed in the bores of adjacent hinge knuckles for providing relative pivoting of the hinge leaves. In one embodiment, the hinge pin extends partially into the bore of the knuckles to define a cavity in each of the hinge knuckles. The hinge pin includes a slot to receive one or more electrical wires extending between the cavities in the respective hinge knuckles. A conduit is formed in each hinge leaf and communicates through a hole in the respective hinge knuckle to the cavity, such that the wires extend from the cavity along the conduit and out through the back of each hinge leaf.

16 Claims, 3 Drawing Figures

TWO KNUCKLE ELECTRICAL HINGE

BACKGROUND OF THE INVENTION

The present invention is a two-knuckle hinge for passing electrical current.

A number of applications exist where it is necessary to provide a source of electric current within a pivotable door or window, in which case it is necessary to pass an electrical wire or wires from the frame of the door or window to the door or window itself. Examples of such applications are electrically operated door latches, card activated entry systems, door locking mechanisms which automatically release the door in the event of a fire, and electrical systems to monitor and energize alarm systems. Typically, electricity is passed to the door through a wire disposed in one of the door hinges.

Several hinge constructions are known for passing an electrical wire to the door. In such known hinges, an electrical wire enters the rear face of one of the hinge leaves, and extends through conduits to the other hinge leaf, whereupon it exits again through the rear face of the other hinge leaf. Preferably, the electrical wires are concealed totally within the hinge so as to protect the wire from damage or tampering. Lawrence U.S. Pat. No. 4,116,514, the Crane et al. U.S. Pat. No. 3,857,625, and the Peterson U.S. Pat. No. 3,838,234 disclose examples of known arrangements. In each device a wire, extending through one hinge leaf, is directed to the other leaf through a longitudinal bore drilled or formed in the hinge pin extending between adjacent hinge knuckles. While such a configuration acts to conceal the wire in the hinge, the formation or drilling of a bore through a hinge pin is undesirable from the standpoint of cost, and tends to complicate the design in comparison to a corresponding non-electric hinge.

An alternate construction for passing a concealed electrical wire from one hinge leaf to the other is disclosed in U.S. Pat. No. 3,842,386 in the name of Charles R. Suska, the inventor herein. The facing bores of two adjacent hinge knuckles are enlarged in the vicinity of their abutting ends to provide an annular cavity, between the hinge pin and knuckles, common to the two knuckles. An electrical wire, introduced from one hinge leaf into the cavity of its corresponding hinge knuckle extends along the hinge pin into the cavity of the adjacent hinge knuckle and out through a conduit in the other hinge leaf. This avoids the necessity of having to drill a hole in the hinge pin.

SUMMARY OF THE INVENTION

The present invention is a two knuckle hinge for passing electrical current between hinge leaves which is simple in construction and which avoids the necessity of drilling an elongated hole in the hinge pin or providing an oversized portion of the bores of adjacent hinge leaves. The construction is especially suited for use in a two knuckle hinge.

More specifically, the present invention in one embodiment, is a two knuckle hinge, having adjacent, axially aligned hinge knuckles. A hinge pin is disposed in the bores of the adjacent hinge knuckles, but extends from the abutting surfaces only partially into the bore of each adjacent knuckle to define a cavity in the remaining portion of the bore. The hinge pin has a slot along its length such that the cavity of each hinge knuckle communicates along the slot with the cavity of the other hinge knuckle. A conduit is provided in each hinge leaf and associated knuckle which extends from the rear face of the leaf through the hinge leaf and knuckle into the cavity of the knuckle. An electrical wire may be threaded through the conduit in one of the leaves and into the cavity of the associated knuckle, along the slot in the hinge pin to the cavity associated with the other knuckle, and thereafter through the conduit of the other leaf out through the rear face of the other leaf.

Preferably, the bore of each hinge knuckle includes an internal shoulder, and a retainer in the form of a washer is screwed onto the end faces of the hinge pin, such that one retainer overlies the shoulder in each bore. The retainers, when screwed into place in the assembled hinge, prevent the hinge from inadvertently being pulled apart, and thus prevent inadvertent damage from occurring to the wires.

A hinge according to the invention is economical to manufacture, in that a minimum number of interfitting pieces are required, and each has a construction readily fabricated. Manufacture is also inexpensive relative to known electrical hinge constructions, which not only possess more complicated and specialized constructions, but which require that a longitudinal bore be formed in the hinge pin. In the present invention, the pin can be cast with the required slot, or the slot may easily be cut in the formed pin.

For a better understanding of the invention, reference is made to the following detailed description of the preferred embodiments, taken in conjunction with the drawings accompanying the application.

DETAILED DESCRIPTION OF THE PREFERRED EMBODIMENTS

Figure 1:
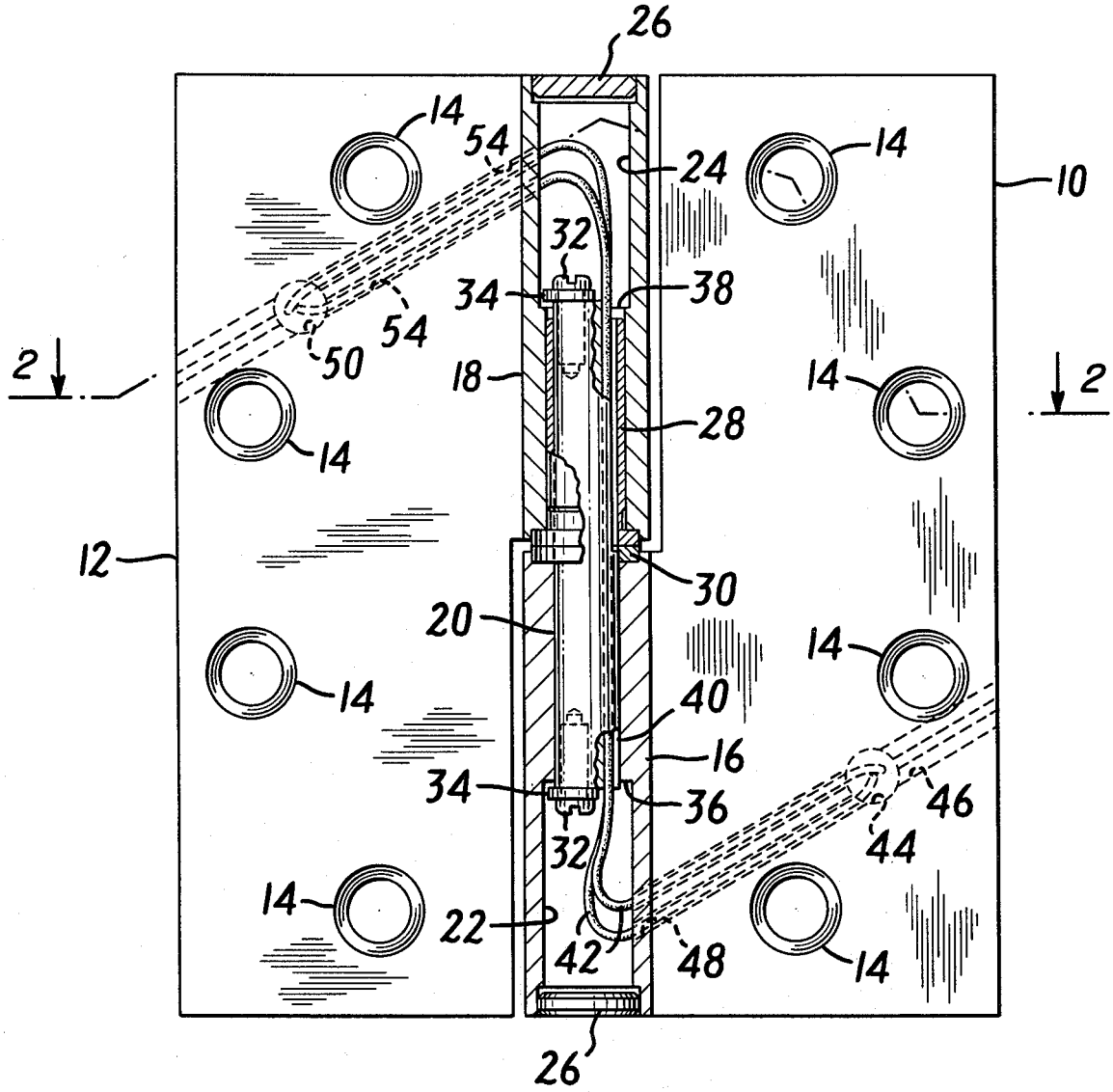
FIG. 1 is a front view, partially in section, of a two knuckle hinge in accordance with the invention.
Figure 2:
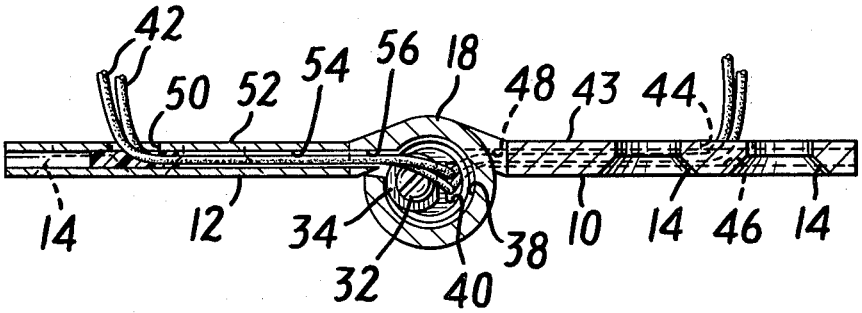
FIG. 2 is a sectional view of the hinge of FIG. 1 taken along lines 2—2.

In the Figs. 1–2 exemplary embodiment, a right-handed two knuckle hinge has a pair of adjacent hinge leaves 10 and 12, each having a plurality of holes 14 for receiving mounting screws. The hinge leaf 10, which is adapted to be attached to a jamb, includes a hinge knuckle 16, and the door leaf 12 includes a hinge knuckle 18 which is supported by the lower hinge knuckle 16. The knuckles 16 and 18 are axially aligned and closely spaced.

Hinge knuckle 18 is relatively pivotable about a hinge pin 20 which extends into the bores of the adjacent hinge knuckles 16 and 18. As shown, however, the hinge pin 20 extends only partially into the bores of each of the knuckles 16 and 18, to define a cavity, 22 or 24, in the outer portion of the bore of each hinge knuckle, 16 or 18, respectively. The bore of each hinge knuckle 16 and 18 is closed off by an end plug 26.

As shown in FIG. 1, the hinge pin 20 is closely spaced within, and preferably press fit into the bore of hinge knuckle 16. A bushing 28 is fitted into the bore of the upper hinge knuckle 18. Preferably, the bushing 28 is fully seated in the bore of the upper knuckle 18, and secured, for example by using epoxy resin. Preferably, the bushing 28 is formed of an electrical insulating material having good mechanical bearing qualities, i.e., a low friction, long wearing and non-abrasive material such as acetal thermoplastic (Delrin) or polyamidethermoplastic (nylon). Preferably, the bushing 28 should also be long enough to separate the insulated wire from the metallic surface of the knuckle 18.

The hinge pin 20 extends up into the bushing, and the bushing 28 and hinge knuckle 18 are pivotable about the hinge pin 20. A bearing 30 may also be seated in the lower hinge knuckle 16, for supporting the bushing 28 and thereby the upper hinge knuckle 18.

The hinge pin 20 is formed to have a slot 40 therein which extends between the cavities 22 and 24. The slot is formed to receive one or more electrical wires 42, which pass through the hinge in a manner described below.

Each end face of the hinge pin 20 is drilled and tapped to receive a screw 32, for example a pan head screw, for securing a retainer 34 in place over the end face. Cooperating with the retainer, the bore of each hinge knuckle 16 and 18 has a shoulder formed therein, 36 and 38, respectively, such that the retainer 34 is disposed over the shoulder 36 or 38 to prevent the separation of the knuckles. As shown in FIG. 2, the retainer is in the form of a washer, having a flat edge facing the slot 40 in the hinge pin 20 so as not to block off the slot 40 and interfere with the passage of the wires 42.

The rear face 43 of the jamb leaf 10 has an opening 44 communicating with a conduit 46 in the hinge leaf 10. Conduit 46 may be drilled from the side edge of the hinge leaf 10 through to the cavity 22, opening into the cavity 22 through a hole 48 in the associated hinge knuckle. The conduit 46 may either be a single conduit to accommodate multiple wires 42, or as shown in FIG. 1, be formed as side-by-side conduits to contain separated wires. Similarly, the door hinge leaf 12 includes an opening 50 in its rear face 52 which communicates with a single channel or multiple channel conduit 54 in the leaf 12 which, through hole 56 in the associated hinge knuckle 18, communicates with the cavity 24. The conduit 52 and hole 56 may be formed in a manner similar to the conduit 46 and hole 48 of the jamb leaf 10 and knuckle 16.

As shown in FIGS. 1–2, a pair of suitably insulated and flexible electrical wires 42 extend into the opening 50 in the rear face 52 of the door leaf 12, along the conduit 54, and through the hole 56 into the upper cavity 24 of the hinge knuckle 18. The wires 42 thereafter extend down the slot 40 in the hinge pin 20 into the lower cavity 22, through the hole 48 and conduit 46 in the lower hinge knuckle 16 and leaf 10, and out through the opening 44 in the rear face 43 of the jamb leaf 10. Preferably, the wires are located in the openings 44 and 50 by epoxy resin so as to be spaced from the edges.

In conventional hinges having three or more interfitting knuckles, the hinge may be used interchangeably in either right-handed or left-handed applications, and knuckles associated with the jamb leaf will support the door-associated knuckles from below to carry the weight of the door. Unlike such multiple knuckle, and thereby non-handed, hinges, however, conventional two knuckle hinges are handed. Depending upon how the hinge is constructed, a two knuckle hinge may be used in either a right-handed application or in a left handed application. However, the same hinge is not interchangeable in both applications, since the hinge leaf associated with the upper of the two knuckles must always be attached to the door or the knuckles will separate.

My co-pending U.S. applications Ser. No. 802,365, filed June 2, 1977 and Ser. No. 042,020, filed May 24, 1979 describe and illustrate embodiments of two knuckle hinges that, unlike conventional two knuckle hinges, are non-handed in application. In accordance with the embodiment of the present invention shown in FIG. 3, a two knuckle hinge is formed to be non-handed and to pass electrical current through the hinge knuckles.

Figure 3:
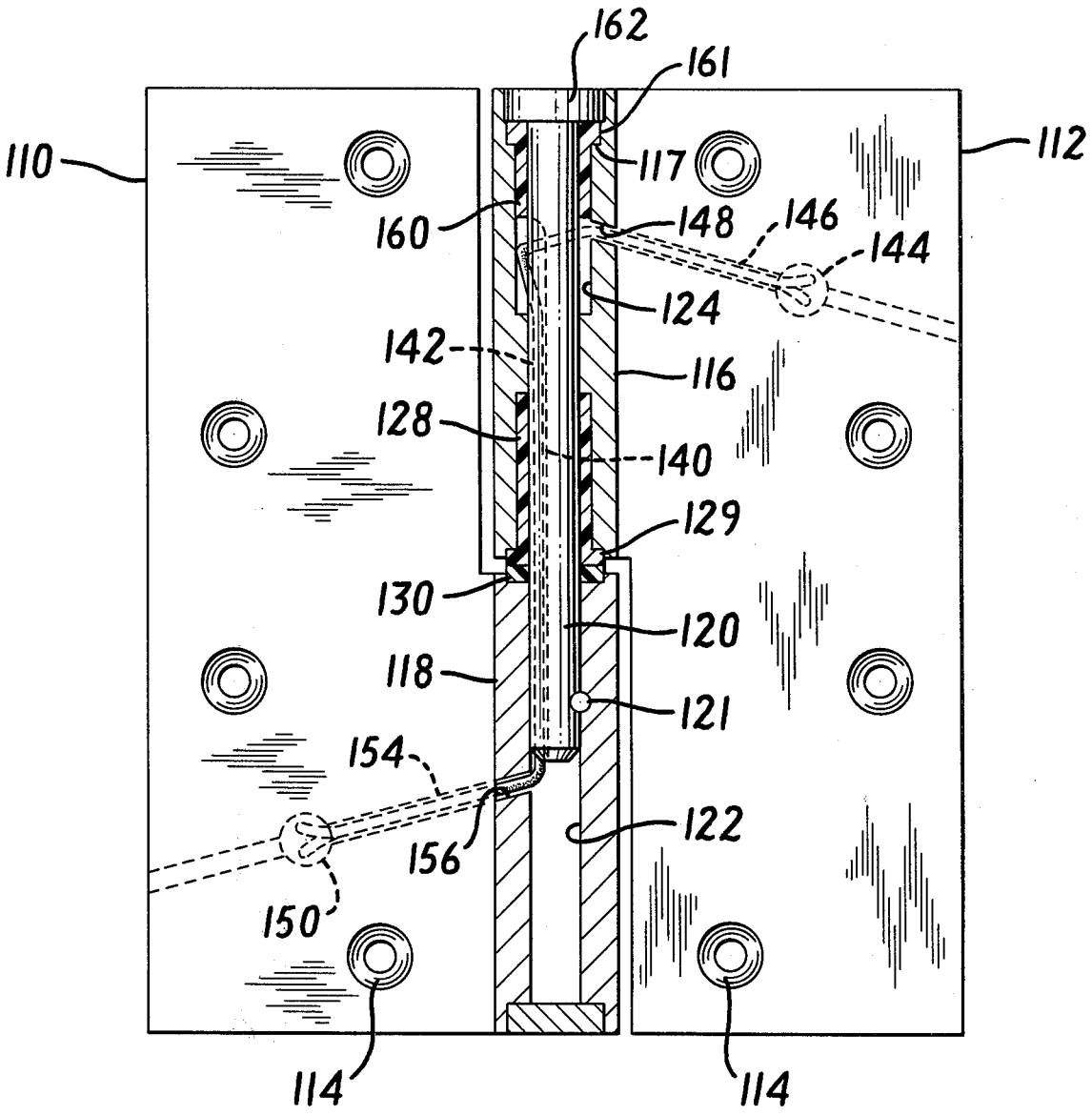
FIG. 3 is a front view, partially in section, of another embodiment of two knuckle hinge in accordance with the invention.

As shown in FIG. 3, a two knuckle hinge has a pair of hinge leaves 110 and 112 having aligned hinge knuckles 118 and 116, respectively, and mounting holes 114 for attaching the leaves to either a door or a jamb. A hinge pin 120 extends pivotably through one hinge knuckle 116 and into the other hinge knuckle 118, where it is secured against axial movement and rotation by a cross pin 121.

An anti-friction sleeve bushing 128 is fitted into the bore of the upper hinge knuckle 116. The bushing 128 has a flanged bearing portion 129 that faces a bearing 130 seated in the lower hinge knuckle 118. The bushing 128 and bearing 130 form a first vertical thrust bearing for supporting the door when the door is hung on the leaf associated with the upper of the two hinge knuckles, i.e. leaf 112 associated with knuckle 116 when the hinge is in the upright position shown in FIG. 3.

The bore of the upper hinge knuckle 116 has an internal shoulder 117 formed therein, that receives and supports a second sleeve bushing 160, having a flanged portion 161 disposed over the shoulder 117. The bushing 160 in turn supports the pintle head 162, such that the shoulder 117, bushing 160 and pintle head form a second vertical thrust bearing when the door is hung on the leaf associated with lower of the two knuckles, i.e. leaf 110 associated with knuckle 118. The second vertical thrust bearing acts in a direction opposite to the first thrust bearing to prevent separation of the hinge, and to permit the hinge to operate normally, when the hinge is used in its opposite hand mode.

The hinge pin 120 has an elongated slot 140 therein which extends between enlarged portions, or cavities 122 and 124, formed in the bore of the respective hinge knuckles 118 and 116. The slot 140 is formed to receive one or more electrical wires 142 which pass through the hinge in a manner similar to the wires 42 of the FIGS. 1–2 embodiment. The rear face of the hinge leaves 110 and 112 have openings 150, 144 that communicate with single conduits 154, 146 and holes 156, 148 in the knuckles 118, 116 leading into cavities 122, 124.

In the illustrated arrangements, the wires are threaded during factory assembly of the hinge. When the hinge is attached to the door and jamb, the free ends of the hinge wires 42 exiting from either leaf are connected to the door and jamb wires to complete the circuit.

The foregoing represents a description of the preferred embodiments of the invention. Modifications and variations will be apparent to persons skilled in the art without departing from the inventive concepts disclosed herein. For example, while the conduits 46 and 53 have been shown as elongated bores formed in the hinge leaves, optionally the conduits 46 and 54 could be formed as slots in the rear face of the hinge leaves, communicating with the respective holes 56 and 48 in the hinge knuckles, and the wires may emerge from the slot at or near the outer edges of the leaves.

In FIGS. 1–2, a right-handed, two knuckle hinge has been shown and described; however, a left-handed hinge may instead be provided, which would be similar in configuration except that the upper knuckle would be associated with leaf 10. Also, while one embodiment of an alternative two knuckle hinge has been shown in FIG. 3, other constructions of hinges, including non-handed, two-knuckle hinges such as shown and described in applications Ser. No. 802,365 and Ser. No. 042,020, which are incorporated herein by reference, may be employed in connection with the invention.

While the hinge pin has been shown and described as having a slot 40 which is rectangular in cross-section, other configurations are possible that may readily be formed or cut in the pin. For example, the slot may be shaped as a V-shaped groove, or may even be flat on the cylindrical surface. As used herein, the term "slot" refers to all such configurations which are formed on or cut in the cylindrical hinge pin surface, and also to any desired arrangement such as a spiral or portion of a spiral along the pin. All such modifications and variations are intended to be within the scope of the invention as defined in the following claims.

I claim:

1. A hinge for mounting a door in a frame and for passing electric current between the door and frame through a concealed, tamperproof electrical wire comprising a first hinge leaf having a first hinge knuckle, a second hinge leaf having a second hinge knuckle, said first and second knuckles having axially aligned bores, a solid hinge pin disposed in the bores of said first and second knuckles and having a slot extending between the bores of said first and second knuckles for receiving a wire, first conduit means in said first leaf and knuckle for passing a wire from said first leaf to said slot, and second conduit means in said second leaf and knuckle for passing a wire from said slot to said second leaf.

2. A hinge as defined in claim 1, wherein said hinge pin extends only partially into each said bore to define a cavity in each said knuckle, wherein said slot extends along the length of said hinge pin to communicate between said cavities, and wherein said first and second conduit means include a hole in each respective hinge knuckle opening into the cavity of said first and second hinge knuckles, respectively.

3. A hinge as defined in claim 1 or 2, wherein the hinge is a two knuckle hinge, and comprising means for preventing the separation of said hinge knuckles.

4. A hinge as defined in claim 2, wherein the hinge is a two knuckle hinge and the bore of each said knuckle has an internal shoulder, and comprising means on said hinge pin for engaging said shoulders for preventing the separation of said hinge knuckles.

5. A hinge as defined in claim 2, wherein said hinge is a two knuckle hinge.

6. A hinge as defined in claim 5, wherein the bore of at least one of said knuckles has an internal shoulder therein, wherein said hinge pin has an end face disposed in said one knuckle with a longitudinal hole for receiving a screw, and comprising a retainer for preventing separation of said one knuckle and said hinge pin and a screw in said hole attaching said retainer to said end face to overlie said shoulder.

7. A hinge as defined in claims 2, 4, or 5, wherein said first and second conduit means comprise a conduit in each said respective hinge leaf communicating with the hole in each said respective hinge knuckle.

8. A hinge as defined in claim 7, wherein each said leaf comprises a rear face, and each said conduit includes an opening in its respective rear face for introducing a wire into said conduit.

9. A hinge as defined in claim 8, comprising at least one wire extending continuously through the opening and conduit of said first leaf, through the hole and into the cavity of said first knuckle, along said slot into the cavity of said second knuckle, through the hole in said second knuckle, and out through the conduit and opening in said second hinge leaf.

10. A hinge as defined in claim 9, wherein said hinge pin is non-rotatably secured in the bore of one hinge knuckle, and is pivotable in the bore of the other hinge knuckle, and comprising a bushing in the bore of said other hinge knuckle between said hinge pin and said other knuckle.

11. A hinge as defined in claim 10, wherein said bushing is formed of an anti-friction, electrically insulating material, and is substantially co-extensive with said hinge pin.

12. A non-handed, two knuckle hinge for mounting a door in a frame and for passing electric current between the door and frame through a concealed, tamperproof electrical wire comprising a pair of hinge leaves, each said leaf including means for mounting the leaf to one of a door and a jamb, a hinge knuckle associated with each leaf, said hinge knuckles having axially aligned bores, a solid hinge pin pivotably extending through the bore of one of said knuckles and into the bore of the other of said knuckles, means for securing said pin in said other knuckle against axial movement, first bearing means between said knuckles for acting as a vertical thrust bearing when a door is mounted to the leaf associated with the upper of the two knuckles, and second bearing means in the bore of said one knuckle between said hinge pin and said one knuckle for acting as a vertical thrust bearing when the door is mounted to the leaf associated with the lower of the two knuckles, wherein said hinge pin has a slot extending between the bores of said knuckles for receiving a wire, first conduit means in one said leaf and knuckle for passing a wire from said one leaf to said slot, and second conduit means in the other said leaf and knuckle for passing a wire from said slot to said other leaf.

13. A hinge as defined in claim 12, wherein the bore of each knuckle has a cavity communicating between said slot and said first and second conduit means, respectively.

14. A hinge as defined in claim 13, wherein said second bearing means comprises a pintle head on said hinge pin and an internal shoulder portion in said one knuckle, and wherein the cavity in said one knuckle comprises an annular cavity between said hinge pin and said knuckle.

15. A hinge as defined in claim 14, wherein said first bearing means comprises a first anti-friction bushing disposed about said pintle in the bore of said one knuckle.

16. A hinge as defined in claim 15, wherein said second bearing means comprises a second anti-friction bushing, disposed about said pintle in the bore of said one knuckle, wherein said second bushing has a bearing portion between said internal shoulder and said pintle head, and wherein said first and second bearings extend partially along the bore of said one knuckle to define, therebetween, the cavity in said one knuckle.

* * * * *